US006361624B1

(12) United States Patent
Altemus

(10) Patent No.: US 6,361,624 B1
(45) Date of Patent: Mar. 26, 2002

(54) FULLY-STABILIZED STEEL FOR PORCELAIN ENAMELING

(75) Inventor: George Franklin Altemus, Shaler Township, Allegheny County, PA (US)

(73) Assignee: USX Corporation, Pittsburgh, PA (US)

( * ) Notice: Subject to any disclaimer, the term of this patent is extended or adjusted under 35 U.S.C. 154(b) by 0 days.

(21) Appl. No.: 09/659,144

(22) Filed: Sep. 11, 2000

(51) Int. Cl.[7] ..... C21D 8/02; C22C 38/12; C22C 38/14

(52) U.S. Cl. ..... 148/320; 148/603; 148/651; 420/126; 420/127; 420/128; 420/129

(58) Field of Search ..... 148/320, 603, 148/651; 420/126–129

(56) References Cited

U.S. PATENT DOCUMENTS

| | | | | |
|---|---|---|---|---|
| 3,950,191 | A | | 4/1976 | Ito |
| 4,124,412 | A | | 11/1978 | Elias |
| 4,670,065 | A | | 6/1987 | Yasuda |
| 4,801,341 | A | | 1/1989 | Itami |
| 5,041,166 | A | | 8/1991 | Matsuoka |
| 5,098,491 | A | | 3/1992 | Osawa |
| 5,137,584 | A | | 8/1992 | Jesseman |
| 5,853,659 | A | * | 12/1998 | Seikita et al. ..... 420/92 |
| 5,853,903 | A | | 12/1998 | Hosoya |

FOREIGN PATENT DOCUMENTS

| | | | |
|---|---|---|---|
| JP | 60110845 | | 6/1985 |
| JP | 61276958 | | 12/1986 |
| JP | 403126814 A | * | 5/1991 |

* cited by examiner

*Primary Examiner*—Deborah Yee
(74) *Attorney, Agent, or Firm*—USX Corporation; William F. Riesmeyer, III

(57) ABSTRACT

A method of producing a fully stabilized extra low carbon porcelain enameling steel having excellent formability and fish scaling resistance as well as superior enamel adherence. The method includes hot rolling a slab to strip, the slab having a composition consisting essentially of in weight percent: 0.005 max. C, 0.35 max. Mn, 0.015 max. P, 0.015 max. S, 0.015 max. Si, 0.025 to 0.055 Al, 0.006 to 0.015 N, 0.03 to 0.06 Ti, 0.02 to 0.05 Cb, up to 0.03 Sb, the balance Fe and inevitable impurities. The hot rolled strip is cold rolled at least 65% and box annealed until a cold spot temperature within the range of 610 to 705 degrees C. is reached. The invention includes the product made according to the process.

6 Claims, No Drawings

FULLY-STABILIZED STEEL FOR PORCELAIN ENAMELING

TECHNICAL FIELD

This invention relates to a method for producing fully-stabilized steel sheet and strip for porcelain enameling applications, and particularly to a method for producing fully-stabilized extra-low carbon steel sheet and strip containing titanium, columbium and antimony, and having excellent formability and fishscale resistance, as well as improved porcelain enamel adherence. The method includes hot rolling an extra-low carbon steel slab containing titanium and columbium to sheet or strip, cold rolling, box annealing and temper rolling. The invention includes the fully stabilized steel sheet and strip produced by the process.

BACKGROUND ART

Steel sheet and strip for household appliances such as cooktops, ranges, washers and dryers are produced using one of three types of porcelain enameling steel. Type I enameling steels are made from a low carbon steel melt usually containing 0.04 to 0.06% carbon. The steel is cast, hot rolled, cold rolled, and then open coil annealed in a decarburizing atmosphere to achieve an ultra low carbon content of less than 0.008%. Type II enameling steels are made from a low carbon melt typically containing about 0.04% carbon maximum. The steel is cast, hot rolled, cold rolled and annealed in a reducing atmosphere at controlled temperatures to avoid the formation of carbides at or near the surface of the strip. Type III enameling steels are produced from a fully stabilized extra-low carbon melt, typically containing 0.01% carbon or less. Aluminum and titanium are added in amounts sufficient to combine with all the carbon, nitrogen, and sulfur present and thereby eliminate aging and yield point elongation. Several chemical elements including titanium, columbium, vanadium, and zirconium can be used to stabilize steel, but titanium is considered the most effective. However, titanium-stabilized steels in which large amounts of titanium have been added exhibit poorer enamel adherence, generally believed to be due to the excess titanium needed to assure complete stabilization, as disclosed in Japanese published patent application No. 60-110845. Titanium-stabilized steels are also noted for poor surface quality and weld area defects such as blowholes in weld zones, as disclosed in Japanese published patent application No. 61-276958.

U.S. Pat. No. 4,670,065 to Yasuda et al discloses a cold rolled steel sheet containing titanium and antimony that is suitable for enamel coating. The steel contains in weight percent up to 0.005 C, up to 0.02 P, up to 0.03 S, 0.005 to 0.012 N, up to 0.15 Ti with Ti≧(48/12 C+48/14 N+48/32 S), up to 0.08 Cu, and at least one member selected from As, Sb, and Bi in a total amount of 0.003% to 0.03% or Se and/or Te in a total amount of 0.003% to 0.05%, the balance being iron and impurities. The steel is produced by continuous casting a molten steel having the aforementioned composition, hot rolling, and cold rolling. The steel may be continuously annealed at a temperature in the range from the recrystallization temperature to the $A_{c3}$ point. Or the steel may be box annealed at a temperature in the range from the recrystallization temperature to 800° C. The reference steel is fully stabilized with titanium and not partially stabilized with titanium with the balance of stabilizing elements necessary for full stabilization being provided by columbium as in Applicant's invention.

U.S. Pat. No. 5,098,491 to Osawa et al discloses a steel sheet containing titanium and columbium for porcelain enameling applications. In one aspect the steel contains in weight percent not more than 0.005 C, not more than 0.59 Mn, 0.007 to 0.020 B, 0.01 to 0.07 Cu, not more than 0.010 Al, 0.008 to 0.020O, 0.005 to 0.020 N, not more than 0.020 P, at least one of not more than 0.050 Ti and not more than 0.050 Nb, provided the total Ti and Nb is within a range of 0.001 to 0.050, the balance iron and inevitable impurities. The steel is hot rolled, cold rolled not less than 70%, and then continuously annealed at a temperature of not lower than 800° C. but not higher than the $Ac_3$ temperature. The reference steel contains boron for combining with the nitrogen. The reference also places an upper limit of 0.050% on the total amount of Ti plus Cb so that the recystallization temperature in continuous annealing is not raised. In addition, the reference teaches that continuous annealing is used so that surface segregation and grain boundary segregation of certain components in the steel exerting a bad influence on enameling can be controlled to make the properties in the steel uniform. The reference does indicate that box annealing can be used in addition to continuous annealing. Applicant's steel does not contain boron, is not continuously annealed, and has higher Ti plus Cb than the steel of the reference.

Two other patents disclose columbium-containing porcelain enameling steels. U.S. Pat. No. 4,124,412 to Elias et al discloses a process for producing non-aging, vacuum degassed low carbon steel. The process includes providing a molten steel having a maximum carbon content of 0.05% and sufficient manganese to combine substantially completely with the sulfur present in the steel. The steel is vacuum degassed to a carbon content of 0.015% max., an oxygen content of about 0.010% max., and a nitrogen content of 0.012% max. Columbium is added to the molten steel in an amount at least sufficient to retard the recrystallization rate of the steel. The steel is cast and hot rolled with a finishing temperature of 1500 to 1700° F. and coiled at a temperature of 1500° F. or less. The final steel product contains in weight percent 0.002 to 0.015 C, above 0.025 to 0.30 Cb, 0.05 to 0.60 Mn, up to 0.035 S, up to 0.010 O, up to 0.012 N, up to 0.08 Al, residual P, residual Si, the remainder substantially iron. The reference steel does not provide full stabilization with a combination of titanium and columbium as in Applicant's invention.

U.S. Pat. No. 5,137,584 to Jesseman discloses a high strength steel for porcelain enameling consisting essentially of in weight percent at least 0.005 Nb, at least 0.02 C, at least 0.10 Mn, at least 0.01 Al, nitrogen as an impurity, the ratio of acid soluble Al to N being at lest 2:1, the balance iron and unavoidable impurities. The steel is produced by hot rolling with a finishing temperature at least at the $Ar_3$ temperature and coiling at a temperature of at least 677° C. to precipitate residual nitrogen as AlN. The steel is descaled, cold rolled and annealed without decarburization at a temperature less than 721° C. for a time sufficient to avoid formation of iron carbides on the surfaces of the sheet and to precipitate the Nb as Nb-carbide. The sheet is then temper rolled. The reference steel does not contain titanium and columbium as in Applicant's invention.

A cold rolled sheet containing boron and having excellent enamelability is disclosed in U.S. Pat. No. 3,950,191 to Ito et al. The steel is produced by providing molten steel containing in weight percent not more than 0.020 C, not more than 0.03 Si, not more than 0.50 Mn, not more than 0.010 Al, not more than 0.050 0O, B within a range of 0.003-0.020 with B ×O more than $1\times10^{-5}$, the remainder Fe and inevitable impurities. The steel is hot rolled, cold rolled and recrystallization annealed in conventional manner. The reference steel does not contain titanium and columbium as in Applicant's invention.

A hot rolled sheet suitable for enameling on one side is disclosed in U.S. Pat. No. 4,801,341 to Itami et al. The steel consists essentially of in weight percent 0.0050–0.07 C, 0.05–1.5 Mn, 0.03–0.15 P, 0.03–0.1 Al, 0.003–0.010 N, at least 0.002 free N not bound to Al, with the ratio of Al/free N being ≧10 and the balance being Fe and incidental impurities. The reference steel does not contain titanium and columbium as in Applicant's invention.

An ultralow carbon cold rolled deep drawing steel sheet containing Ti and Nb is disclosed in U.S. Pat. No. 5,041,166 to Matsuoka et al. The steel contains up to about 0.005 C, up to about 0.1 Si, up to about 1.0 Mn, up to about 0.1 P, up to about 0.05 S, about 0.01 to 0.10 Al, up to about 0.005 N, one or two elements from the group of about 0.01 to 0.15 Ti, about 0.001 to 0.05 Nb and about 0.0001 to 0.002 B, the balance substantially Fe and incidental impurities. The steel sheet is produced by hot rolling, primary cold rolling more than 30%, intermediate annealing, secondary cold rolling more than 30% to provide total rolling not smaller than about 78% and final annealing. The reference steel is not a porcelain enameling steel and has a lower nitrogen content than Applicant's invention. Also the reference steel contains boron whereas Applicant's steel does not. Finally, the reference does not suggest partial stabilization of porcelain enameling steel with titanium, with the balance of a stabilizing element necessary being provided by columbium.

An ultralow carbon cold rolled steel sheet or a zinc or zinc alloy coated steel sheet containing Ti and Nb is disclosed in U.S. Pat. No. 5,853,903 to Hosoya et al. The steel contains 0.001 to 0.01 C, 0 to 0.2 Si, 0.1 to 1.5 Mn, 0 to 0.5 P, 0 to 0.02 S, 0.03 to 0.10 Al, 0 to 0.004 N, one or both of 0.005 to 0.08 Nb and 0.01 to 0.07 Ti within ranges given by $$\{(12/93)Nb+(12/48)Ti^*\}\geqq 0.0005 \text{ and } 0\leqq C-\{(12/93)Nb+(12/48)Ti^*\}\leqq 0.0015$$

wherein $Ti^*=Ti-\{(48/32)S+(48/14)N\}$. The reference steel is not a porcelain enameling steel and has lower N than Applicant's invention.

DISCLOSURE OF INVENTION

The present invention is of a method for producing fully stabilized extra-low carbon steel sheet and strip suitable for porcelain enameling applications. The method includes hot rolling a steel slab to sheet or strip in coil form, said slab consisting essentially in weight percent of 0.005 max. C, 0.35 max. Mn, 0.015 max. P, 0.015 max. S, 0.015 max. Si, 0.025 to 0.055 Al, 0.006 to 0.015 N, 0.03 to 0.06 Ti, 0.02 to 0.05 Cb, up to 0.03 Sb, the balance Fe and incidental impurities. The method further includes cold rolling the hot rolled coil substantially to final thickness with a minimum cold reduction of 65%, and box annealing the cold rolled coil to a cold spot temperature within the range of 610 to 705° C. The invention also includes a steel strip product produced according to the above process and having porcelain bond adherence of 4.0 to 4.5 on a two-coat, one-fire system, or 3.0 to 3.5 on a one-coat, one-fire ground coat system, as measured by the Gardner drop weight deformation device according to ASTM C 988-83.

MODES FOR CARRYING OUT THE INVENTION

According to the present invention, a slab is provided which has a composition consisting essentially of in weight percent:

| | |
|---|---|
| 0.005 | max. C, |
| 0.35 | max. Mn |
| 0.015 | max. P |
| 0.015 | max. S |
| 0.015 | max. Si |
| 0.025 | to 0.055 Al |
| 0.006 | to 0.015 N |
| 0.03 | to 0.06 Ti |
| 0.02 | to 0.05 Cb |
| up | to 0.03 Sb |
| the balance Fe and inevitable impurities. | |

the balance Fe and inevitable impurities.

The steel slab may be produced by conventional basic oxygen steelmaking, vacuum degassing and continuous casting practices. The slab is hot rolled to coil in conventional fashion with a finishing temperature preferably within a range of 865 to 927 degrees C. (1590 to 1700 degrees F.) and a coiling temperature preferably within a range of 650 to 677 degrees C. (1200 to 1250 degrees F.). The steel coil is then preferably descaled, for example by pickling, and cold rolled substantially to final thickness with a minimum cold reduction of at least 65 percent. Increased percent cold reduction greater than 65 percent provides higher r values which is desirable. The cold rolled steel coil is then box annealed in a protective atmosphere until a cold spot temperature of the coil reaches a temperature within the range of 610 to 705 degrees C. (1135 to 1300 degrees F.). Preferably, the coil is box annealed until a cold spot temperature within a range of 690 to 705 degrees C. (1275 to 1300 degrees F.) is reached. The annealed coil is then temper rolled as required for flatness.

The reasons for selecting the particular chemical composition of the steel are set forth below.

Carbon:

Carbon in solid solution increases hardness while decreasing ductility and r-value or plastic strain ratio of the steel. These deleterious effects as well as that of strain aging can be minimized or eliminated by stabilizing the carbon with titanium and/or columbium. Carbon in excess of 0.005% deteriorates ductility and increases the amount of titanium and/or columbium required to combine with the carbon, resulting in increased costs and a deterioration in enamel adherence. Consequently, the carbon level is limited to 0.005% max.

Manganese:

Manganese greater than 0.35% decreases the ductility of the steel. Therefore the upper limit of manganese is set at 0.35%. Preferably at least 0.20% manganese is provided in the steel so that manganese sulfides will form in preference to titanium or columbium sulfide, thereby reducing the amount of titanium or columbium needed to combine with the carbon and stabilize the steel. Most preferably, the manganese content is within a range of 0.25 to 0.35%.

Sulfur:

Sulfur has a deleterious effect on the steel in that it induces hot shortness and causes surface defects to occur during hot rolling. For these reasons sulfur is limited to 0.015% max.

Phosphorus:

Phosphorus is limited to a residual amount of 0.015% since it tends to harden the steel.

Silicon:

Silicon is also limited to a residual amount since it tends to harden the steel. Above 0.015% silicon the hardening effect is harmful.

Aluminum:

Aluminum is added for deoxidation of the steel and improves the efficiency and recovery of additions of manganese, titanium and columbium to the steel in the steelmaking process. A minimum of at least 0.025% aluminum is required for this purpose. The upper limit of aluminum is set at 0.055% because aluminum is expensive and higher levels tend to clog refractory nozzles and interfere with continuous casting of the steel.

Nitrogen:

Nitrogen is added to the steel in an amount of at least 0.006% in order to form sufficient titanium and/or columbium nitrides for preventing fishscaling defects that otherwise occur during baking of the porcelain enamel coating that is applied to the steel. Large nitride particles generate mechanical voids in the steel microstructure during cold rolling and serve to trap hydrogen gas within the steel. This prevents the hydrogen from escaping to the steel surface and causing flaking or fishscaling of the porcelain coating. The nitrogen content is limited to 0.015% in order to limit the amount of titanium and columbium required to combine with the nitrogen so as not to cause surface defects that would otherwise occur in the steel sheet. Preferably the nitrogen range is 0.010 to 0.013%.

Titanium:

Titanium is added to the steel to form titanium nitrides that are beneficial for preventing fishscale defects in the porcelain enamel coated sheet. Excess titanium that remains after forming titanium nitride combines with carbon to form titanium carbides in the steel. The elimination of free carbon from the steel is desirable for preventing strain aging. However, the amount of titanium added to the steel is limited in order to prevent surface defects that occur when the amount of excess titanium is high, and to avoid degradation in enamel adherence inherent with high titanium levels. Therefore, the upper limit of titanium is restricted to 0.06%. On the other hand titanium is a more efficient carbide former than columbium and it is desirable to utilize titanium to form titanium nitride for the prevention of fish scale defects in preference to columbium. Therefore, the lower limit of titanium is set at 0.03%. Preferably the lower limit of titanium is 0.04% when the nitrogen is within the preferred range of 0.010 to 0.013%.

Columbium:

Columbium is added to the steel in order to combine with any nitrogen and carbon that has not been combined with titanium. Columbium does not appear to have the deleterious effect on enamel adherence that is caused by excess titanium. Accordingly, the lower limit of columbium is set at 0.02% in order to be sure that sufficient columbium is present to combine with all of the nitrogen and carbon that remains uncombined with titanium. On the other hand, greater amounts of columbium are not required and are expensive. Accordingly, the upper limit of columbium is set at 0.05%. Preferably, the lower limit of columbium is 0.03% when the nitrogen is within the preferred range of 0.010 to 0.013%.

Antimony:

Antimony is not normally needed and is not added since the steel is generally cleaned rather than pickled prior to enamel coating. However, for those few applications where the steel is pickled and nickel flash coated prior to enameling, antimony is added in an amount of at least 0.010% for controlling the deposition of pickling products on the steel surface that are harmful to enamel adherence. Excess antimony is expensive and unnecessary and therefore the upper limit of antimony is set at 0.03%.

The balance of the steel composition is iron and incidental impurities that inevitably occur as a result of the steelmaking process.

EXAMPLE

A commercial heat was melted and refined using the basic oxygen process. The heat was vacuum degassed and continuously cast into slabs. The slabs were hot rolled into coils with an average finishing temperature of 934° C. (1714° F.) and an average coiling temperature of 674° C. (1245° F.). The hot rolled coils were then pickled, cold rolled and box annealed in hydrogen to a minimum cold spot temperature of 690 degrees C. (1275 degrees F.). The coils were subsequently temper rolled with an approximately 0.75% extension. Samples were taken from three coils and tested for chemical composition. The results are shown in Table 1 below.

TABLE 1

| No. | C | Mn | P | S | Si | Ti | Al | N | Cb | Sb |
|---|---|---|---|---|---|---|---|---|---|---|
| 1 | .0031 | .34 | .008 | .015 | .011 | .057 | .043 | .010 | .049 | .025 |
| 2 | .0036 | .35 | .008 | .014 | .010 | .057 | .046 | .010 | .049 | .024 |
| 3 | .0039 | .34 | .009 | .014 | .012 | .055 | .040 | .010 | .050 | .024 |

The samples were also tested for mechanical properties and the results are set forth in Table 2 below.

TABLE 2

| Sample No. | Yield Str. (kgf/mm$^2$) | Tensile Str. (kgf/mm$^2$) | Elong. % | $r_m$ |
|---|---|---|---|---|
| 1A | 15.4 | 32.5 | 46 | 2.1 |
| 1B | 15.2 | 32.6 | 45 | 2.1 |
| 1C | 15.4 | 32.5 | 44 | 2.0 |
| 2A | 16.4 | 33.1 | 44 | 2.1 |
| 2B | 16.1 | 32.9 | 45 | 2.1 |
| 2C | 16.2 | 32.8 | 45 | 2.1 |
| 3A | 17.6 | 34.3 | 44 | 1.8 |
| 3B | 17.7 | 34.4 | 42 | 1.7 |
| 3C | 17.7 | 34.5 | 45 | 1.7 |

The samples were also tested for enameling adherence and fishscale resistance. The test panels were prepared by using a typical appliance two coat, one fire enamel system. The results are given in Table 3 below.

TABLE 3

| Sample No. | Fishscaling | Adherence* |
|---|---|---|
| 1A | None | 4.0 |
| 1B | None | 4.0 |
| 1C | None | 4.0 |
| 1D | None | 4.0 |
| 1E | None | 4.0 |
| 1F | None | 4.0 |
| 2A | None | 3.5 |
| 2B | None | 4.0 |
| 2C | None | 4.0 |
| 2D | None | 3.5 |
| 2E | None | 3.5 |
| 2F | None | 3.5 |
| 3A | None | 4.0 |
| 3B | None | 4.5 |
| 3C | None | 4.5 |
| 3D | None | 4.5 |

TABLE 3-continued

| Sample No. | Fishscaling | Adherence* |
|---|---|---|
| 3E | None | 4.5 |
| 3F | None | 4.5 |

*Adherence as determined using a Gardner Drop Weight Deformation Tester. Adherence is rated 0 (poor) to 5 (excellent). A rating of 3.0 or greater is acceptable. No fishscaling was encountered.

Thus, a type 3 enameling steel is provided having excellent formability and fishscale resistance and improved porcelain adherence.

What is claimed is:

1. A method for producing a fully stabilized porcelain enameling steel, said method comprising:

a) hot rolling a steel slab to strip in coil form, said slab having a composition consisting essentially of in weight percent:

| | |
|---|---|
| 0.005 | max. C, |
| 0.35 | max. Mn |
| 0.015 | max. P |
| 0.015 | max. S |
| 0.015 | max. Si |
| 0.025 to 0.055 | Al |
| 0.006 to 0.015 | N |
| 0.03 to 0.06 | Ti |
| 0.02 to 0.05 | Cb |
| up to 0.03 | Sb |
| the balance Fe and inevitable impurities; | |

b) cold rolling the hot rolled strip substantially to final thickness with a minimum cold reduction of at least 65 percent; and c) box annealing the cold rolled strip in coil form in a protective atmosphere until a cold spot temperature of the coil reaches a temperature within the range of 610 to 705 degrees C. (1135 to 1300 degrees F.).

2. The method of claim 1 wherein the Mn content of said slab is within the range of 0.25 to 0.35.

3. The method of claim 1 wherein the nitrogen is within a range of 0.010 to 0.013%, the lower limit of Ti is 0.04%, and the lower limit of Cb is 0.03%.

4. The method of claim 1 wherein said cold rolled strip is box annealed in coil form until a cold spot temperature within a range of 690 to 705 degrees C. (1275 to 1300 degrees F.) is reached.

5. The method of claim 1 further comprising descaling the hot rolled strip and temper rolling the box annealed coil to improve the flatness of the strip.

6. A steel product produced according to a method of any of claims 1–5, said steel product having porcelain bond adherence of 4.0 to 4.5 on a two coat, one fire porcelain enamel coating system, or 3.0 to 3.5 on a one-coat, one-fire ground coat porcelain enamel coating system, as measured by the Gardner drop weight deformation device according to ASTM C 988-83, wherein a rating of 0 represents poor adherence and a rating of 5 represents excellent adherence.

* * * * *